US005906343A

United States Patent [19]

Battey et al.

[11] Patent Number: 5,906,343

[45] Date of Patent: May 25, 1999

[54] CHAIR BASE

[75] Inventors: Robert J. Battey, Kentwood; Robert S. Grooters, Grand Rapids; Kurt R. Heidmann, Grand Rapids; John L. Hendricks, Grand Rapids; Michael A. Kolarik, Kentwood; Brian H. Root, Grandville; Bruce G. Rose, Freeport; Robert M. Scheper, Grand Rapids, all of Mich.

[73] Assignee: Steelcase Inc., Grand Rapids, Mich.

[21] Appl. No.: 08/859,328

[22] Filed: May 20, 1997

[51] Int. Cl.[6] ..... A47B 91/00

[52] U.S. Cl. ..... 248/188.7; 248/188.8; 16/30

[58] Field of Search ..... 248/188.1, 188.7, 248/188.8, 188.9, 345.1; 16/30; 297/227, 411.46, 411.45

[56] References Cited

U.S. PATENT DOCUMENTS

| | | | |
|---|---|---|---|
| Re. 23,665 | 6/1953 | Pettibone | 248/345.1 |
| 334,756 | 1/1886 | Denver | 297/411.45 |
| 1,810,817 | 6/1931 | Brainard et al. . | |
| 2,292,445 | 8/1942 | Hilldring | 248/345.1 |
| 2,690,212 | 9/1954 | Jakeway . | |
| 2,732,157 | 1/1956 | Hamilton . | |
| 2,913,208 | 11/1959 | McKinley | 248/188.7 |
| 2,954,637 | 10/1960 | Scherer . | |
| 3,137,527 | 6/1964 | Hoven et al. | 297/411.45 |
| 3,148,855 | 9/1964 | Hamilton | 248/188.7 |
| 3,289,995 | 12/1966 | Taylor . | |
| 3,617,023 | 11/1971 | Schneiderman . | |
| 3,705,704 | 12/1972 | Textoris . | |
| 4,084,776 | 4/1978 | Cook | 248/188.7 |
| 4,118,855 | 10/1978 | Lequeux . | |
| 4,262,871 | 4/1981 | Kolk et al. . | |
| 4,331,360 | 5/1982 | Roudybush et al. | 297/411.45 |
| 4,365,839 | 12/1982 | Strassle . | |
| 4,370,373 | 1/1983 | Janicz . | |
| 4,412,667 | 11/1983 | Doerner | 248/188.9 X |
| 4,534,533 | 8/1985 | Doerner . | |
| 4,744,538 | 5/1988 | Hofman . | |
| 4,810,550 | 3/1989 | Gasser . | |
| 4,971,849 | 11/1990 | Azzar . | |
| 4,998,699 | 3/1991 | Butler . | |
| 5,009,468 | 4/1991 | Fomby | 297/411.45 |
| 5,026,588 | 6/1991 | Diekmann . | |
| 5,048,780 | 9/1991 | Borsani . | |
| 5,402,973 | 4/1995 | Haines . | |
| 5,478,137 | 12/1995 | Olson et al. | 297/227 X |

*Primary Examiner*—Ramon O. Ramirez
*Assistant Examiner*—Derek J. Berger
*Attorney, Agent, or Firm*—Price, Heneveld, Cooper, DeWitt & Litton

[57] ABSTRACT

A chair base includes a leg assembly having a plurality of radially-extending legs, and a leg cover adapted to cover the legs. The tubular legs have a top surface divided by a center line and have apertures offset from the center line. The leg covers are adapted to cover the legs, and the leg covers including downwardly extending off-centered bosses for engaging the apertures. Each of the tubular legs have an end with aligned vertical holes therein. A sleeve-like pintle retainer is located in the aligned vertical holes and flared at its top and bottom to hold the pintle retainer in the tubular legs. The leg assembly includes a tubular center hub. The plurality of radially extending tubular legs each have a top wall, a bottom wall and opposing side walls, the top and bottom walls each having an arcuately shaped end engaging the center hub. A pair of ring welds extend continuously circumferentially around the center hub for welding the arcuately shaped ends of the top and bottom walls to the center hub. In a modified form the covers include a plurality of flat-topped intermediate retainers shaped for attachment to a top of the legs, and a plurality of aesthetic flat-bottomed trim pieces shaped for mating adhering attachment to the top of the retainers.

34 Claims, 6 Drawing Sheets

Fig. 7
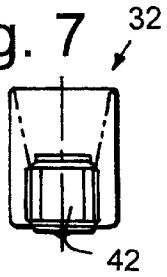
Fig. 8
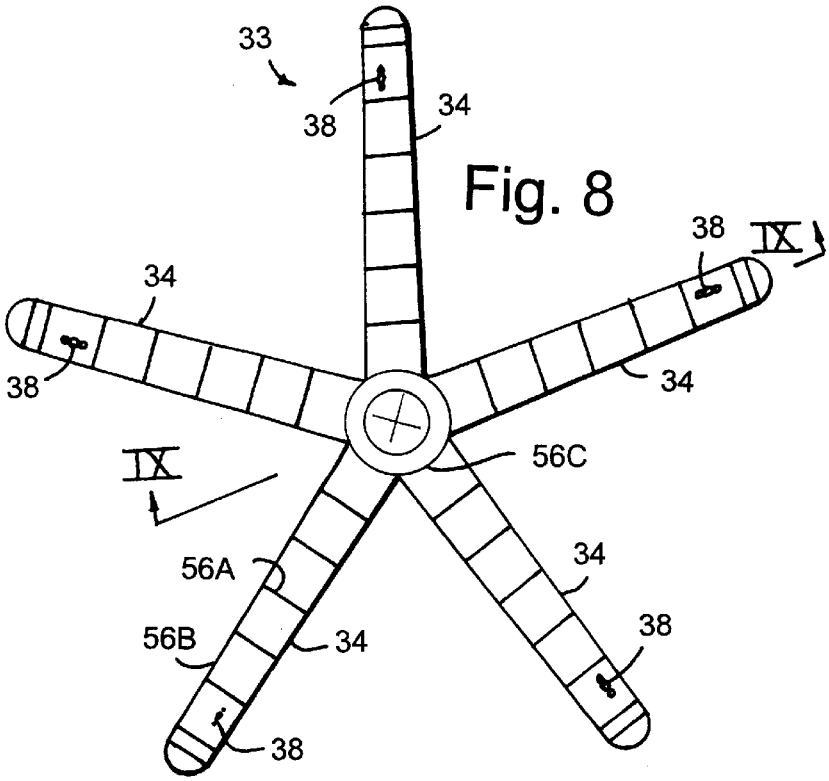
Fig. 9
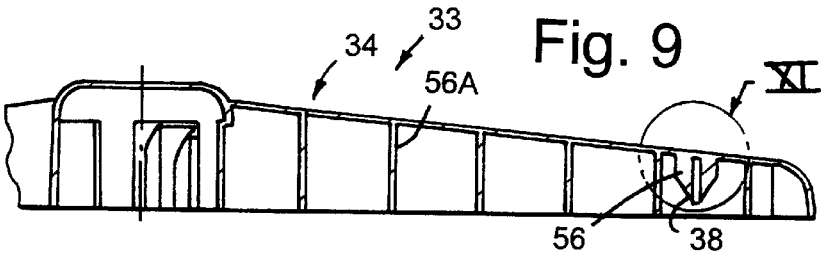
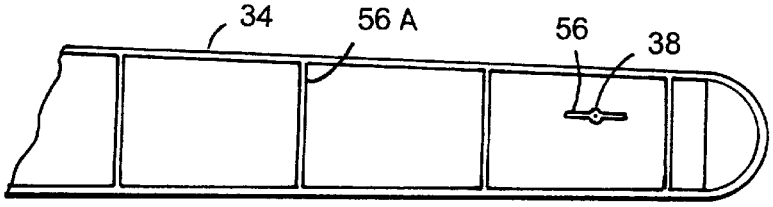
Fig. 10

Fig. 17
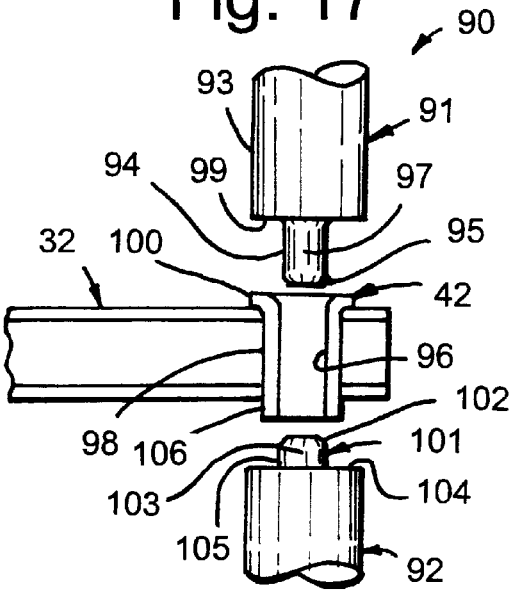
Fig. 18
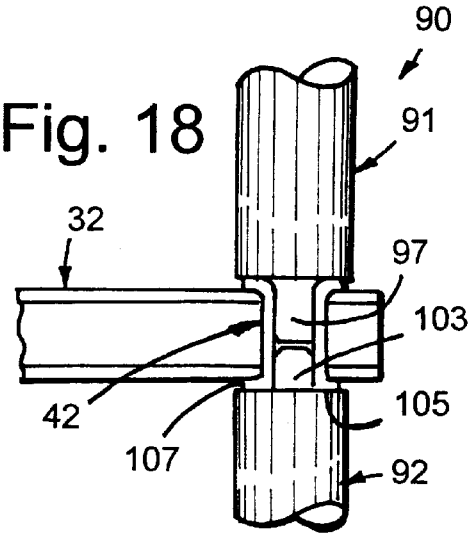
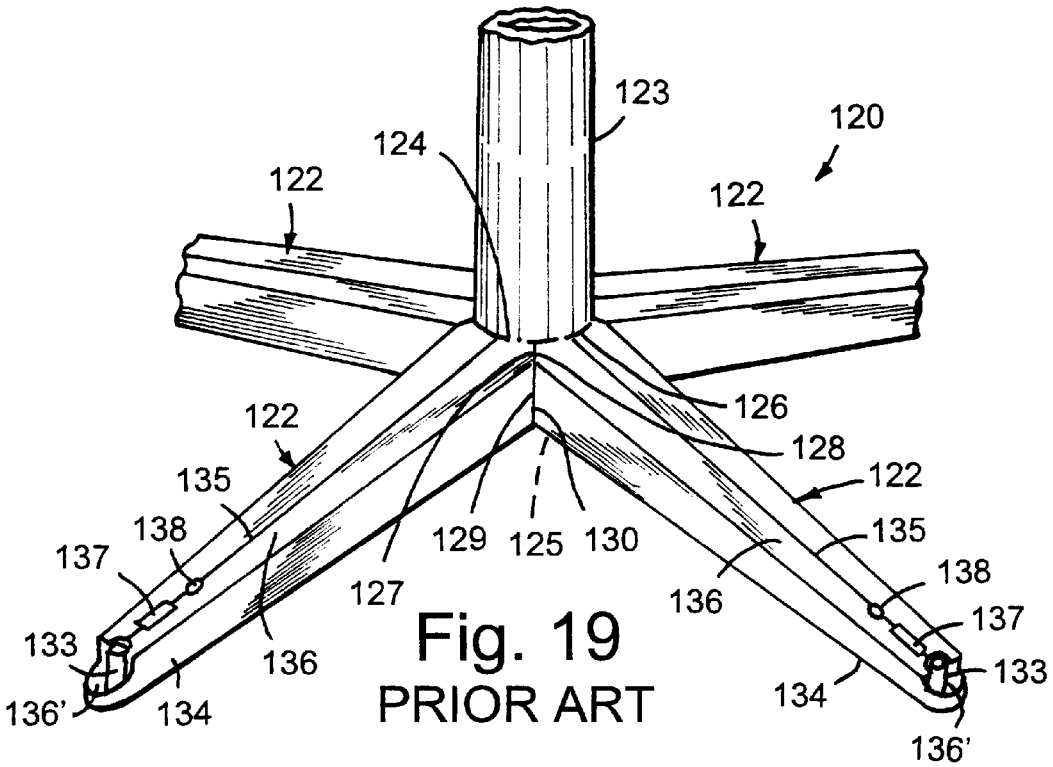
Fig. 19
PRIOR ART

CHAIR BASE

BACKGROUND OF THE INVENTION

The present invention relates to chair bases, and more particularly to chair bases constructed to improve manufactureability and reduce cost while maintaining aesthetics.

Chairs often include bases with radially extending legs with casters on their ends for movably supporting the chairs. The legs must be structurally sound for supporting the weight of the chair and a person seated in the chair. The legs must also be visually attractive since at least a portion of the legs are visible when looking down at the chair from a few feet away. This can be problematic since materials strong enough to provide the structural strength desired may be difficult to aesthetically cover. Also, some legs have peculiar cross sectional shapes that are difficult to uniformly paint or coat. For example, some customers desire chrome plated legs on their chairs. However, chrome plating processes have severe limitations concerning the type of materials that can be plated and the depth that the chrome plating material can be thrown. Another problem is that many coatings unacceptably show through surface defects, such as weld marks, scuff marks, and any other surface inconsistencies. Still another problem is that people often put their feet on the legs while seated in the chair, thus tending to scratch and scuff the top of the legs. A chair base construction is desired having reduced manufacturing costs, but that allows use of coating materials having high wear resistance and an attractive appearance.

Many chair bases include a sleeve-like central hub and radially extending legs with casters on their outer ends. The legs undergo considerable stress based on their cantilevered construction, and for this reason must be attached to the central hub repeatably, consistently, and securely. However, it can be difficult to weld the legs to the central hub since the legs interfere with clear access to the area of the joint when welding 360° around the joint. Further, the legs must be accurately welded, since the casters on the ends of the legs must all touch the floor. Thus, it has been difficult to automate the leg-to-hub joining process, and also difficult to consistently make a high quality joint.

Accordingly, a chair base solving the aforementioned problems is desired.

SUMMARY OF THE INVENTION

In one aspect, a chair base includes tubular legs, each leg having a top surface divided by a center line and having apertures offset from the center line. Leg covers are provided for covering the legs, the leg covers including downwardly extending off-centered bosses for engaging the apertures.

In another aspect, the present invention includes a chair base with a plurality of radially-extending legs. A plurality of flat-topped intermediate retainers are provided shaped for attachment to the legs, and a plurality of aesthetic flat-bottomed trim pieces are provided, the trim pieces being shaped for mating attachment to the top of the retainers.

In yet another aspect, a chair base includes tubular legs each having an end with aligned vertical holes therein. A sleeve-like pintle retainer is located in the aligned vertical holes and flared at its top and bottom to hold the pintle retainer in the tubular legs. Leg covers are attached to the legs for covering the tubular legs including the pintle retainer.

In still another aspect, a chair base includes a tubular center hub, and a plurality of radially extending tubular legs.

Each leg has a top wall, a bottom wall, and opposing side walls, with the top and bottom walls each having an arcuately shaped end for closely engaging the center hub and with side walls of adjacent legs being located close together at the hub. A pair of ring welds extend continuously circumferentially around the center hub for welding the arcuately shaped ends of the top and bottom walls to the center hub.

These and other features and advantages of the present invention will be further understood and appreciated by those skilled in the art by reference to the following specification, claims, and appended drawings.

DESCRIPTION OF DRAWINGS

FIG. 7 is an end view of the leg shown in FIGS. 5–6;

FIG. 8 is a bottom view of the leg cover shown in FIG. 1;

FIG. 9 is a cross sectional view taken along the line IX—IX in FIG. 8;

FIG. 10 is an enlarged fragmentary bottom view of an end of the leg shown in FIG. 9;

FIGS. 17 and 18 are side cross sections showing the tubular pintle retainer, including a pair of tools configured to simultaneously support and deform the tubular pintle retainers, FIG. 17 showing the tools spread apart and FIG. 18 showing the tools closed together; and FIGS. 19 and 20 are fragmentary perspective views of prior art chair bases.

DETAILED DESCRIPTION OF PREFERRED EMBODIMENT

Figure 1:
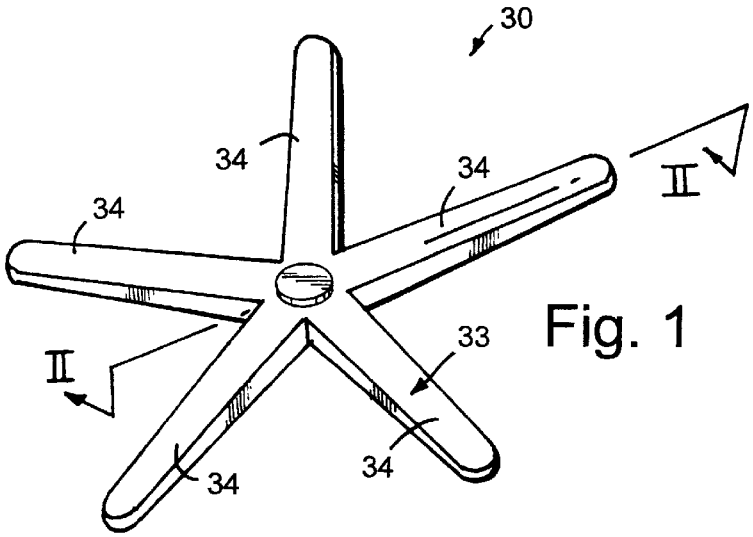
FIG. 1 is a perspective view of a chair base embodying the present invention.

For purposes of description herein, the terms "upper", "lower", "right", "left", "rear", "front", "vertical", "horizontal", and derivatives thereof shall relate to the invention as oriented in FIG. 1 with the bottom of the base being adjacent a floor surface. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
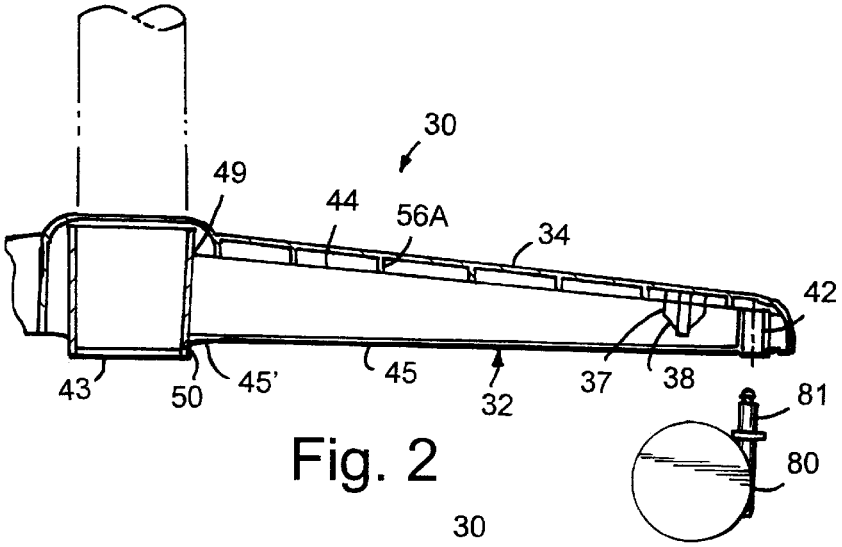
FIG. 2 is a cross sectional view taken along the line II—II in FIG. 1.
Figure 3:
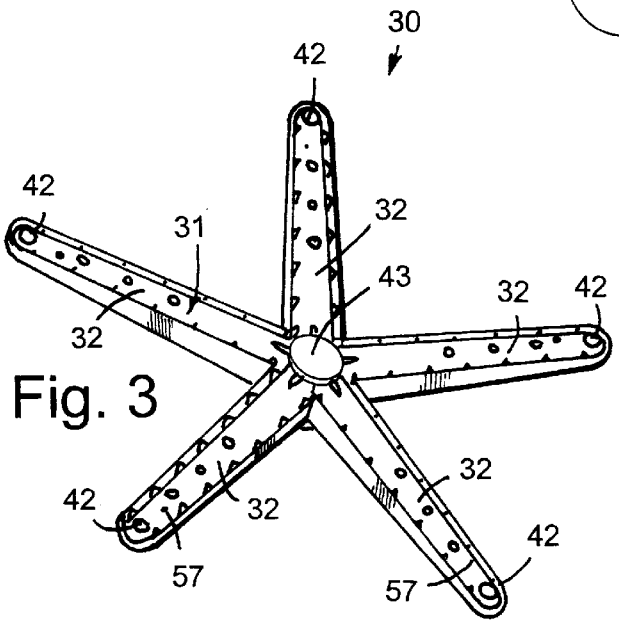
FIG. 3 is a bottom perspective view of the chair base shown in FIG. 1.

A chair base 30 (FIG. 1) embodying the present invention includes a leg assembly 31 having a plurality of radially-extending tubular legs 32, and a leg cover 33 with sections 34 adapted to cover the legs 32. The tubular legs 32 (FIG. 4) each have a top surface 35 divided by a weld along its center line 36 and have an aperture 37 off-set to one side of the center line 36 near an end of the respective legs. The leg cover sections 34 (FIG. 2) each include downwardly extending off-centered bosses 38 for frictionally engaging the apertures 37, as described below.

Figure 5:
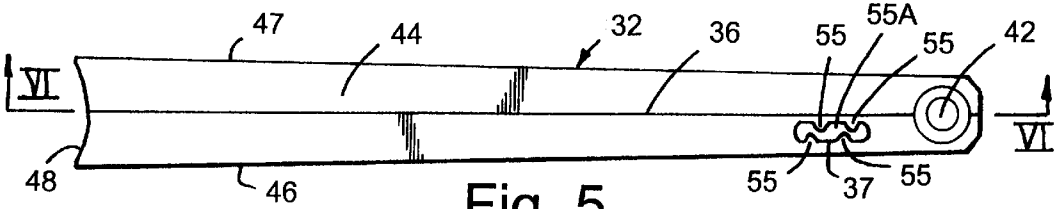
FIG. 5 is a top view of a leg of the leg assembly shown in FIG. 4.
Figure 11:
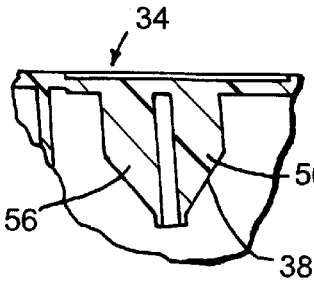
FIG. 11 is an enlarged fragmentary view of the circled area XI in FIG. 10.

The apertures 37 (FIG. 5) have an oblong shape, and each side includes two tines 55 that extend about one-third to one-half of the way into the aperture 37. The tines 55 on each side are spaced apart so that they define a space 55A for receiving a respective boss 38, but so that the tines 55 frictionally engage the sides of the boss 38 to prevent its removal. The bosses 38 (FIG. 11) on the leg cover sections 34 are braced by reinforcement ribs 56 that interferingly frictionally fit between the tips of opposing tines 55. By locating the apertures 37 (FIG. 5) offset to one side of the tubular section of leg sections 32, the complete apertures 37 can be preformed in the sheet metal before forming the tube, and therefore the apertures 37 can more accurately formed. Also, the weld line in the tube does not have to skip or avoid the apertures. Also, the weld line can be located in a symmetrical location on the tubular section, so that the forming and welding processes for forming the tubular legs 32 are more consistent and controllable.

Figure 12:
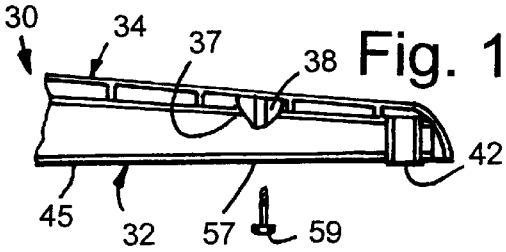
FIG. 12 is an exploded side cross sectional view showing an alternative assembly method of attaching the leg cover onto a tubular leg.
Figure 13:
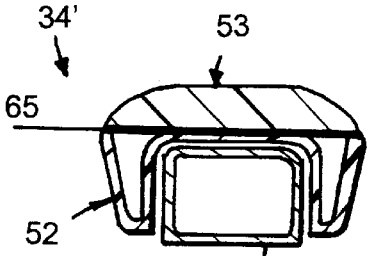
FIG. 13 is a cross sectional view of a modified leg assembly including a tubular leg, a retainer, and a cover.
Figure 14:
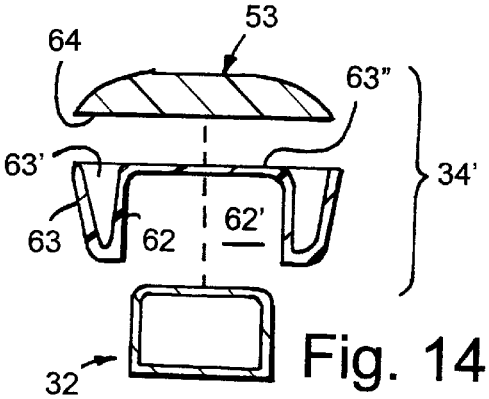
FIG. 14 is an exploded view of the modified leg assembly of FIG. 13.

The boss 38 (FIG. 12) includes a concentric hole 57 extending inwardly from its lower end. A hole 58 is located on a bottom wall 45 of leg section 32 so that it is vertically aligned with the hole 57. If leg cover 33 is removed several times from the leg assembly 31, the tines 55 may not frictionally engage the boss 38 and ribs 56 with enough force to securely and stably hold the cover 33 on the leg assembly 31. In such event, a screw 59 is extended through the hole 57 into the boss 58 to secure the cover 33 in place on the leg assembly 31.

Leg cover 33 (FIG. 8) includes gussets and reinforcement ribs 56A that stiffen the side flanges 56B of the leg sections 34, and further include a hub-covering center flange 56C. Additional flanges and gussets can be added as desired for functional and aesthetic reasons.

Figure 6:
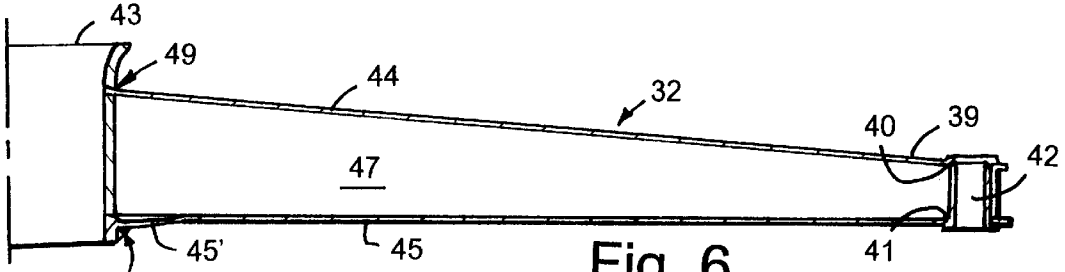
FIG. 6 is a cross sectional view taken along the line VI—VI in FIG. 5.
Figure 15:
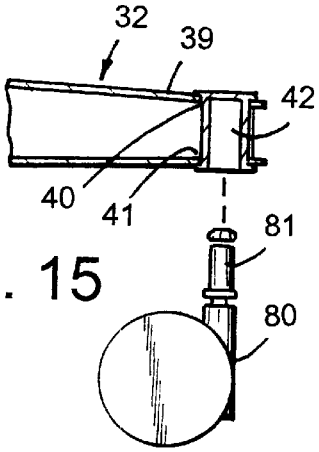
FIG. 15 is an exploded fragmentary view of an end of a leg including a tubular pintle retainer and a caster having a pintle for engaging the tubular pintle retainer.

Each of the tubular legs 32 (FIGS. 6 and 15) are formed from single sheets, and have an end 39 with aligned vertical holes 40 and 41 therein. A sleeve-like pintle retainer or receiver 42 is located in the aligned vertical holes and is flared at its top and bottom to hold the pintle retainer 42 in the tubular legs 32. Optimally, one end is flanged on the retainer 42 before assembly, so that the retainer can be slipped into the holes 40 and 41 until it seats in the holes. Thereafter, the other end is flared to make the assembly permanent. Preferably, pintle retainer 42 is made of deep draw steel to facilitate the process of mechanically deforming the upper end of the retainer 42 after the retainer is inserted into a leg 32. The process for deforming the upper end includes a tool having opposing top and bottom punch members with a protruding tip that maintains the ID of the retainer 42 as an outer radiused ledge deforms the top end outwardly. A caster 80 (FIG. 15) includes a pintle 81 adapted to frictionally engage the ID of the pintle retainer 42.

Figure 4:
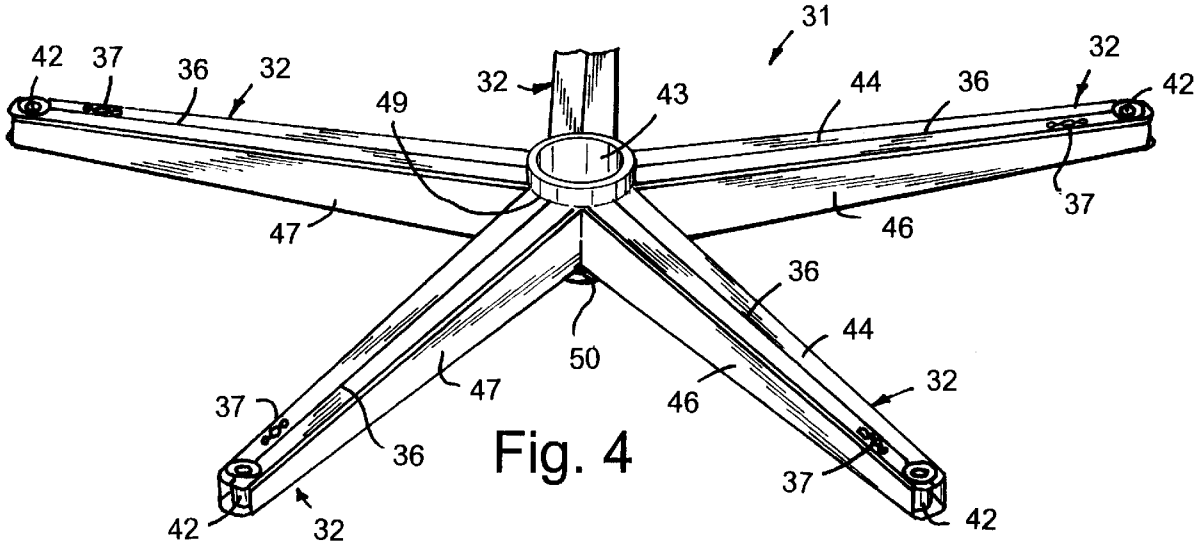
FIG. 4 is a fragmentary perspective view of the leg assembly shown in FIG. 2.

The leg assembly 31 includes a tubular center hub 43 (FIG. 4). It is noted that hub 43 can be a taper-fit type hub as shown, or can be another type hub such as non-taper-fit hubs or other hubs known in the industry. The plurality of radially extending tubular legs 32 each have a top wall 44, a bottom wall 45 and opposing side walls 46 and 47, the top and bottom walls 44 and 45 each having an arcuately shaped inner end 48 (FIG. 5) engaging the center hub 43. An angled stiffening rib 45' is formed in bottom wall 45 at hub 43 to provide increased strength to the connection of each leg 32 to the hub 43. The large flat sections of walls 44–47, also provide optimal beam tensile/compressive/torsional strength to each leg 32. A pair of ring welds 49 and 50 (FIG. 4) extend continuously circumferentially around the center hub 43 to secure the arcuately shaped ends 48 of the top and bottom walls 44 and 45 to the center hub 43. To form leg assembly 31, the leg sections 32 are fixtured abuttingly against the center hub 43. The welding station then welds a bead continuously around the center hub 43 in parallel horizontal planes where the top walls 44 and the bottom walls 45 abut the center hub 43. This welding process is advantageously very repeatable and can be consistently performed to create uniform welds. Further, the location of the welds are in very accessible locations since they are above or below the legs. It is noted that the strength of the joint is not believed to be seriously reduced by the absence of a weld on the side walls of the legs since these areas have a reduced moment arm and thus are not as structurally important for strength of the welded assembly.

In a modified form leg cover sections 34 include a plurality of flat-topped intermediate retainers 52 shaped for attachment to a top of the legs 32, and a plurality of aesthetic flat-bottomed trim pieces 53 shaped for mating attachment to the top of the retainers 52. This allows the trim pieces 53 to be formed in an optimal shape so that they can be made with minimal scrap and with maximum appearance and wear properties. Retainers 52 include an inverted U-shaped body 62 with a lower recess 62' adapted to fit over the leg sections 32. The retainers 52 include bosses and reinforcement ribs like the bosses 38 and ribs 56 described above. The retainers 52 further include an upwardly formed outer flanges 63 for providing support to the trim piece 53 at a location spaced laterally from the top wall 44 of leg section 32. The outer flange 63 is supported by ribs 63'. The trim pieces 53 typically have a simple geometric shape, so that they are easy to manufacture with minimal scrap, and with minimal machining and secondary operations. For example, it is contemplated that the illustrated shape is relatively easy to chrome plate. The flat bottom 64 provides a convenient surface for receiving an adhesive 65 to securely hold the trim pieces 53 on the respective flat top surfaces 63" of their respective retainers 52. The inner end of the trim pieces 53 are shaped to matingly cover the visible portion of center hub 43, and can include downwardly extending sides on skirts for covering the sides of the retainers 52 if desired.

Figure 16:
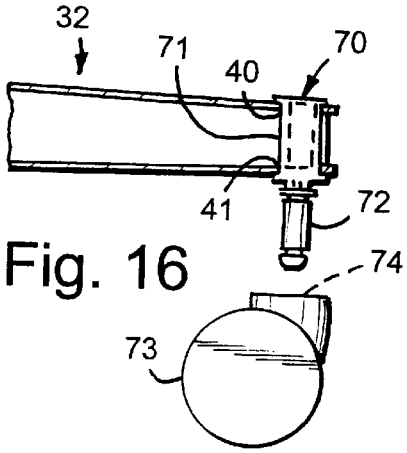
FIG. 16 is an exploded fragmentary view of a modified pintle retainer in an end of a leg, the modified pintle retainer including a pintle and the caster including a pintle-receiving recess.

A modified pintle member 70 (FIG. 16) can be used in place of sleeve-like pintle receiver 42. Pintle member 70 includes a top portion 71 that is like pintle receiver 42. However, in pintle member 70, a pintle-like protrusion 72 is preattached to or integrally formed with the lower end of the top portion 71 and extends downwardly. The pintle-like protrusion 72 is shaped to frictionally engage a caster 73 having a recess 74 for receiving the pintle-like protrusion 72.

FIGS. 17 and 18 disclose a tool 90 having upper and lower punch-like tool members 91 and 92 adapted to close together for deforming tubular pintle retainer 42. Upper tool 91 includes a shaft 93 with a protrusion 94 extending axially therefrom. Protrusion 94 includes angled lead-in surface 95 to facilitate centering the upper tool 91 while extending protrusion 94 into the bore of retainer 42 defined by inner surface 96. The diameter of the bore of inner surface 96 is important, since the diameter greatly affects the frictional insertion and retention forces of retaining a pintle of a caster 80 in the bore (see FIG. 2). Protrusion 94 (FIG. 17) includes a cylindrical support section 97 shaped to closely engage inner surface 96, to thus support the midsection 98 of pintle receiver 42. Upper tool 91 further includes a radially extending ring-shaped abutment surface 99 configured to engage and abut preformed end flange 100 of pintle retainer 42, as shown in FIG. 18.

The lower tool 92 (FIG. 17) is shaped similarly to upper tool 91, but its axially-extending protrusion 101 is slightly shorter than upper protrusion 94. Lower protrusion 101 includes angled lead-in surface 102, and a cylindrical support section 103. A radially-extending ring-shaped abutment surface 104 is formed at a base of lower protrusion 101, and is joined to cylindrical support section 103 by a generously radiused surface 105. Radiused surface 105 is constructed to deform the lower end 106 of pintle receiver 42 as lower tool 92 is moved toward upper tool 91. A circumferential flange 107 (FIG. 18) is formed on lower end 106 as tool 92 is forced to a closed position, as end 106 moves across radiused surface 105.

It is contemplated that the position of tools 91 and 92 can be reversed and/or that the pintle receiver 42 can be inverted in leg 32 so that the preformed flange 100 is on the bottom. It is also contemplated that pintle receiver 42 can be a tube section not having any preformed flanges thereon. In such case, the tube section is fixtured/held in the leg 33, and the tools 91 and 92 form flanges on both of the ends simultaneously.

PRIOR ART

Figure 20:
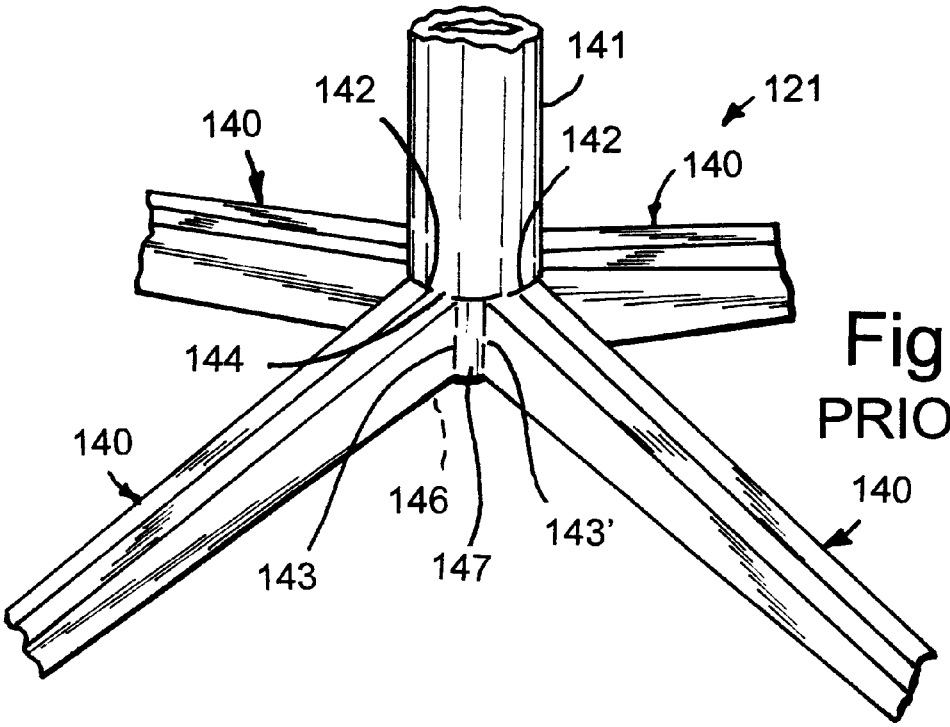
Fig. 20 PRIOR ART

Two prior art chair bases 120 (FIG. 19) and 121 (FIG. 20) are shown. Chair base 120 includes tubular legs 122 (FIG. 19) welded to a hub 123 with top and bottom continuous ring welds 124 and 125. The inner end 126 of each tubular leg 122 is arcuately shaped so that it mateably engages the hub 123 prior to welding. The sides of the inner end 126 of the leg 122 is cut at an angle on opposing sides so that the top and bottom angled surfaces 127 of one leg 122 mateably abuts a corresponding angled surface 128 on the next leg 122. The top and bottom angled surfaces 127 are not welded together, but the adjacent vertical surfaces 129 and 130 are welded together. Notably, there is a space or gap between the welds on vertical surfaces 129 (and 130) and the welds 124/125 on hub 123 such that the ring welds 124 and 125 and the vertical welds 131 are not connected, making the welding process discontinuous and inefficient.

A sleeve-like tubular pintle retainer 133 is welded in an outer end 134 of each leg 122. The leg 122 is tubular, and is formed by a sheet bent into the shape of a generally rectangular tube. Side edges of the sheet are welded together along weld line 135 at the symmetrical center of the top wall 136 of leg 122. The end of top wall 136 is open at location 136' to facilitate placing the pintle receiver 133 therein before welding. A square hole 137 for receiving a tab on a leg cover (not shown) and a round hole 138 for receiving a screw-receiving boss on a leg cover (not shown) is formed on top wall 136 at a location centered on weld line 135.

In regard to base 120, it is noted that the welds connecting edges 129 and 130 are difficult to make due to their limited space for access. Also, the angle cut at the inner ends of the legs 122 can be difficult to align during preweld fixturing. Still further, the dimensions and shape of apertures 137 and 138 are difficult to control due to the weld 135 that extends across them. Also, the welding can affect the shape of the pintle retainer 133.

Chair base 121 (FIG. 20) includes legs 140 that are cut to mateably engage hub 141. The legs 140 are welded to hub 141 by inverted U-shaped continuous weld lines 142 that extend up the vertical sides walls 143 of a leg 140 and across the top wall 144 of the same leg 140. The weld lines 142 do not extend across the bottom wall 146 of the legs 140, but instead only a spot weld is used on the bottom to provide a welded connection. Notably, the side wall 143 of one leg 140 is separated/spaced by a space 147 from the side wall 143' of the adjacent leg 140 in the area of engagement with the hub 141. This creates a more open access area so that the separate welds on the sidewalls 143 and 143' are more easily made. However, this construction makes it difficult to weld on the hub 141 unless the hub 141 has a relatively large diameter, for example.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A chair base comprising:

a base including tubular legs with a top wall divided by a weld line defining a center line and having apertures in the top wall offset in a non-symmetrical pattern from the center line; and leg covers for covering the legs, the leg covers including downwardly extending off-centered bosses for engaging the apertures.

2. The chair base defined in claim 1 wherein the weld line is a continuous weld line extending along the center line for a length of each of the tubular legs.

3. The chair base defined in claim 2 wherein the bosses each include material forming a protrusion, and including at least one tab extending into each aperture, the at least one tab being configured to allow each aperture to receive one of the protrusions into the aperture from a first direction, but configured to prevent removal of the one protrusion in an opposite direction.

4. The chair base defined in claim 3 wherein the bosses include stiffening ribs configured to engage the at least one tab.

5. The chair base defined in claim 4 wherein the bosses have a screw hole, the legs each include a bottom wall having a bottom aperture therein aligned with the screw hole in the boss, and including a screw extended through the bottom hole into the screw hole.

6. The chair base defined in claim 2 including opposing tabs extending into each of the apertures.

7. The chair base defined in claim 1 wherein the leg covers have a concave downwardly facing shape for partially covering sides of the tubular legs.

8. The chair base defined in claim 1 including a one-piece molding having sections forming the leg covers.

9. The chair base defined in claim 1 wherein the tubular legs each include end sections having vertically aligned apertures, and including a tubular pintle retainer extended through the aligned apertures and flared so that the tubular pintle retainer is secured to the respective tubular leg, the tubular pintle retainer forming a recess for receiving a pintle on a chair caster.

10. The chair base defined in claim 1 wherein the base includes a center hub, and including top and bottom continuous ring welds for securing the legs to the center hub, the legs each including top and bottom walls that are secured to the hub by the top and bottom ring welds, and further including side walls that are characterized by the side walls of adjacent ones of said legs mechanically abuttingly engaging and stabilizing each other against the hub, and further characterized by the absence of any welds interconnecting the side walls for physically securing the side walls to each other.

11. A chair base comprising:

a base including tubular legs each having an end with aligned vertical holes therein;

a sleeve-like pintle retainer located in the aligned vertical holes and flared flanges at its top and bottom ends to hold the pintle retainer in the tubular legs, the pintle retainer having a continuous cylindrically-shaped middle section with an outer diameter shaped to slide into the aligned vertical holes and with an inner diameter adapted to frictionally engage a pintle on a castor, with the flared flange at the bottom end engaging only a bottom surface of the leg and the flared flange at the top end engaging only a top surface of the leg, such that the flared flanges at the top and bottom ends provide the only structure for holding the pintle retainer in the legs, the pintle retainer being made of a deformable material so that one of the top and bottom ends can be flared after the pintle retainer is telescopingly extended into the aligned holes; and leg covers for covering the tubular legs including the pintle retainer.

12. The chair base defined in claim 11 wherein the pintle retainer is made from deep draw steel.

13. The chair base defined in claim 12 wherein the flared flanges include a preformed flange at one of the top and bottom ends and a mechanically deformed flange flared outwardly during assembly at an opposite one of the top and bottom ends.

14. A chair base comprising:

a tubular center hub;

a plurality of radially extending tubular legs, each leg having a top wall, a bottom wall and opposing side walls, the top and bottom walls each having an arcuately shaped end engaging the center hub, the side walls of adjacent legs abutting each other and the hub; and a connection joining each of the legs to the hub comprising a pair of ring welds extending continuously circumferentially around the center hub for welding the arcuately shaped ends of the top and bottom walls to the center hub, the connection being characterized by an absence of vertical welds securing the abutting side walls to each other and characterized by an absence of vertical welds securing the abutting side walls to the hub, but characterized by the strength of the connection coming in significant part from the side walls of the adjacent legs mechanically abutting and stabilizing each other against the hub in unwelded areas.

15. The chair base defined in claim 14 wherein the bottom walls each include a stiffening rib at a location adjacent the hub.

16. The chair base defined in claim 14 wherein the top wall and the bottom wall include large flat sections that extend from the hub-engaging end to an outer end, the large flat sections providing beam strength to the legs.

17. The chair base defined in claim 16 wherein the legs are each formed from single sheets of material.

18. The chair base defined in claim 14 including a tubular pintle retainer secured in a free end of each tubular leg, the tubular pintle retainer being deep draw steel and having at least one mechanically deformed end for holding the tubular pintle retainer in the free end of each of the legs.

19. A chair base comprising:

a center hub adapted to engage and support a chair; and a plurality of radially extending tubular legs attached to the center hub, each leg having a top wall, a bottom wall, and opposing side walls, the top and bottom walls each having a hub-engaging end connected to the center hub, with the bottom wall further including a stiffening rib formed in the hub-engaging end adjacent the center hub, the stiffening rib extending longitudinally and engaging an outer surface of the center hub and being configured to provide increased strength to a connection of each said tubular leg to the center hub.

20. A chair base comprising:

a center hub adapted to engage and support a chair; and a plurality of radially extending tubular legs attached to the center hub, each leg having a top wall, a bottom wall, and opposing side walls, the top and bottom walls each having a hub-engaging end connected to the center hub, with the bottom wall further including a stiffening rib formed in the hub-engaging end adjacent the center hub, the stiffening rib engaging the center hub and being configured to provide increased strength to a connection of each said tubular leg to the center hub; the stiffening rib extending longitudinally in the bottom wall a distance substantially shorter than a length of the leg.

21. A chair base comprising:

a center hub adapted to engage and support a chair; and a plurality of radially extending tubular legs attached to the center hub, each leg having a top wall, a bottom wall, and opposing side walls, the top and bottom walls each having a hub-engaging end connected to the center hub, with the bottom wall further including a stiffening rib formed in the hub-engaging end adjacent the center hub, the stiffening rib engaging the center hub and being configured to provide increased strength to a connection of each said tubular leg to the center hub, the bottom wall defining a plane, and the stiffening rib extending downwardly at an acute angle relative to the bottom wall into engagement with the hub.

22. The chair base defined in claim 21 wherein the leg has a length, and wherein the stiffening rib extends a longitudinal distance substantially shorter than the length along the bottom wall of the associated tubular leg.

23. A chair base comprising:

a center hub adapted to engage and support a chair; and a plurality of radially extending tubular legs attached to the center hub, each leg having a top wall, a bottom wall, and opposing side walls, the top and bottom walls each having a hub-engaging end connected to the center hub, with the bottom wall further including a stiffening rib formed in the hub-engaging end adjacent the center hub, the stiffening rib engaging the center hub and being configured to provide increased strength to a connection of each said tubular leg to the center hub, the top wall and the bottom wall each including flat sections that extend from the hub-engaging end to an outer end, the flat sections defining non-parallel planes, the rib extending downwardly from the flat section of the bottom wall at the hub-engaging end into engagement with an outer surface of the hub.

24. A chair base comprising:

a center hub adapted to engage and support a chair;

a plurality of radially extending tubular legs attached to the center hub, each leg having a top wall, a bottom wall, and opposing side walls, the top and bottom walls each having a hub-engaging end connected to the center hub, with the bottom wall further including a stiffening rib formed in the hub-engaging end adjacent the center hub, the stiffening rib engaging the center hub and being configured to provide increased strength to a connection of each said tubular leg to the center hub; and the connection of each leg to the center hub being characterized by an absence of vertical welds securing the adjacent side walls together, but further being characterized by the strength of the connection coming in substantial part from the side walls of the adjacent legs mechanically abutting and stabilizing each other against the center hub in unwelded areas.

25. The chair base defined in claim 24 wherein the hub-engaging ends are arcuately shaped to matingly engage the center hub, and including a pair of ring welds extending continuously circumferentially around the center hub to secure the tubular legs to the center hub.

26. The chair base defined in claim 24 wherein the stiffening rib extends a distance longitudinally along the leg that is substantially shorter than a length of the leg.

27. The chair base defined in claim 24 wherein the stiffening rib extends at an angle to the bottom wall.

28. A chair base comprising:

a tubular center hub;

a plurality of radially extending tubular legs positioned circumferentially around the center hub for supporting the center hub on a floor, each leg having a top wall, a bottom wall, and opposing side walls that combine to define a rectangular cross section, the top and bottom walls each having an arcuately-shaped end welded to the center hub with the side walls of adjacent legs mechanically abutting and stabilizing each other against the center hub but characteristically not welded thereto nor to each other, the side walls having a first vertical dimension at the center hub that is greater than a second vertical dimension at an outer end of each leg, such that the legs have a tapered configuration, the tubular legs each being made from a sheet of steel material where the top wall includes a continuous weld line along its length for welding edges of the sheet together to form the tubular leg, the continuous weld line being centered along the top wall and the top wall including apertures non-symmetrically positioned about the weld line, the apertures being adapted to receive and frictionally engage retainers on leg covers for attaching the leg covers to the tubular legs, the bottom wall including an angled stiffening rib adjacent the center hub that is formed in the bottom wall, with an end of the angled stiffening rib abutting the center hub and being configured to provide increased strength to a connection of each said leg to the center hub; and the connection joining each of the legs to the center hub comprising a pair of ring welds extending continuously circumferentially around the center hub for welding the arcuately-shaped ends of the top and bottom walls to the center hub, the connection being characterized by an absence of vertical welds securing the opposing side walls to each other or the center hub, but further being characterized by the strength of the connection coming in substantial part from the side walls of the adjacent legs mechanically abutting each other and the center hub and stabilizing each other against the center hub in unwelded areas.

29. A chair base comprising:

a base including at least one leg configured to provide cantilevered support for stably supporting the base, the at least one leg including a weld line extending longitudinally along the at least one leg, the at least one leg having apertures in the top wall offset non-symmetrically from the weld line; and a leg cover for covering the at least one leg, the leg cover including downwardly extending bosses configured and arranged to engage the apertures.

30. The chair base defined in claim 29 wherein the weld line is a continuous weld line extending along a center line of the at least one leg, and wherein the at least one leg is tubular.

31. The chair base defined in claim 30 wherein the base includes a center hub configured to support a chair, and wherein the at least one leg includes a plurality of radially extending tubular legs, each one of the tubular legs having an inner end attached to the center hub and an outer end configured to engage a floor and to support the hub in a cantilevered manner, the plurality of tubular legs having a combined strength that, in combination with the center hub, are constructed to have a beam strength strong enough to safely support a combined weight of a seated person and a chair on the center hub.

32. A chair base comprising:

a base including a center hub configured to support a chair, and a plurality of radially extending tubular legs, each said one of tubular legs having an inner end attached to the center hub and an outer end configured to engage a floor and to support the hub in a cantilevered manner, the plurality of tubular legs having a combined strength that, in combination with the center hub, are constructed to have a beam strength strong enough to safely support a combined weight of a seated person and a chair on the center hub, the tubular legs each including a bottom wall having a stiffening rib formed therein that engages the center hub;

the legs each including a weld line extending longitudinally along the respective leg and having apertures in the top wall offset from the weld line, the weld line being a continuous weld line extending along a center line of the at least one leg, and wherein the at least one leg is tubular; and leg covers covering each of the legs, the leg covers each including downwardly extending bosses configured and arranged to engage the apertures.

33. A chair base comprising:

a base including a center hub configured to support a chair, and a plurality of radially extending tubular legs, each said one of tubular legs having an inner end attached to the center hub and an outer end configured to engage a floor and to support the hub in a cantilevered manner, the plurality of tubular legs having a combined strength that, in combination with the center hub, are constructed to have a beam strength strong enough to safely support a combined weight of a seated person and a chair on the center hub, top and bottom ring welds securing the legs to the center hub, the legs each including top and bottom walls that are secured to the center hub by the top and bottom ring welds, and further including side walls that are characterized by the side walls of adjacent ones of said legs mechanically abuttingly engaging and stabilizing each other against the center hub, and further characterized by the absence of any welds interconnecting the side walls to each other or to the center hub;

the legs each including a weld line extending longitudinally along the respective leg and having apertures in the top wall offset from the weld line, the weld line being a weld line extending along a center line of the at least one leg, and wherein the at least one leg is tubular; and leg covers covering each of the legs, the leg covers each including downwardly extending bosses configured and arranged to engage the apertures.

34. A chair base comprising:

a hub adapted to stably support a chair; and at least one leg having a hub-engaging inner end attached to the hub, a length, and a radially extending outer end, the at least one leg forming at least one beam having sufficient cantilever strength to support the hub above a floor and to support a combined weight of the chair and a seated person setting on the hub via forces transmitted upwardly into the outer end and along the length and through the inner end to the hub, the at least one leg having a bottom wall and a longitudinally extending, stiffening rib formed in the bottom wall at the hub-engaging end, the stiffening rib extending a distance substantially shorter than a length of the leg and extending downwardly from the bottom wall into engagement with an outer surface of the hub in a manner providing increased strength to a connection of the at least one leg to the hub.

* * * * *